US008608939B2

(12) United States Patent
Den Boestert et al.

(10) Patent No.: US 8,608,939 B2
(45) Date of Patent: Dec. 17, 2013

(54) PROCESS FOR REMOVING ASPHALTENIC PARTICLES

(75) Inventors: Johannes Leendert William Cornelis Den Boestert, Amsterdam (NL); Duurt Renkema, Amsterdam (NL); Marco Jordi In Het Veld, Amsterdam (NL)

(73) Assignee: Shell Oil Company, Houston, TX (US)

( * ) Notice: Subject to any disclaimer, the term of this patent is extended or adjusted under 35 U.S.C. 154(b) by 194 days.

(21) Appl. No.: 13/140,182

(22) PCT Filed: Dec. 17, 2009

(86) PCT No.: PCT/EP2009/067365

§ 371 (c)(1),
(2), (4) Date: Jun. 16, 2011

(87) PCT Pub. No.: WO2010/070025

PCT Pub. Date: Jun. 24, 2010

(65) Prior Publication Data

US 2011/0247964 A1 Oct. 13, 2011

(51) Int. Cl.

| | |
|---|---|
| ***B01D 37/00*** | (2006.01) |
| ***B01D 39/10*** | (2006.01) |
| ***B01D 25/02*** | (2006.01) |

(52) U.S. Cl.
USPC ..... 208/39; 208/187; 208/309; 210/500.1; 210/500.25; 210/348; 210/411

(58) Field of Classification Search
USPC ..... 208/39, 146, 152, 187, 400, 405; 210/500.1, 500.25, 348, 411
See application file for complete search history.

(56) References Cited

U.S. PATENT DOCUMENTS

| | | | | |
|---|---|---|---|---|
| 4,886,118 | A | 12/1989 | Van Meurs et al. | 166/245 |
| 5,785,860 | A * | 7/1998 | Smith | 210/651 |
| 2010/0122939 | A1 * | 5/2010 | Bauer et al. | 208/425 |

FOREIGN PATENT DOCUMENTS

| | | | | |
|---|---|---|---|---|
| EP | 1276959 | | 1/2006 | E21B 43/00 |
| GB | 1255831 | * | 12/1971 | B01D 29/38 |
| WO | WO2004092308 | | 10/2004 | C10G 31/11 |
| WO | WO2007050446 | | 5/2007 | C10G 1/00 |
| WO | WO2008116864 | | 10/2008 | C10G 31/11 |

* cited by examiner

*Primary Examiner* — Walter D Griffin
*Assistant Examiner* — Derek Mueller
(74) *Attorney, Agent, or Firm* — Charles W. Stewart

(57) ABSTRACT

Process for removing asphaltenic particles from a hydrocarbon feed containing asphaltenic particles by treating the feed in a filter unit comprising a perforated tube surrounded by hollow longitudinal projections comprising a filter having openings of at most 50 micrometer diameter in which the internal space of each of the hollow projections is in fluid communication with the inside of the perforated tube and which filter is regularly subjected to cleaning by treating each of the projections with cleaning fluid wherein the flow of cleaning fluid is opposite to the direction of normal flow.

8 Claims, 2 Drawing Sheets

PROCESS FOR REMOVING ASPHALTENIC PARTICLES

PRIORITY CLAIM

Figure 1:
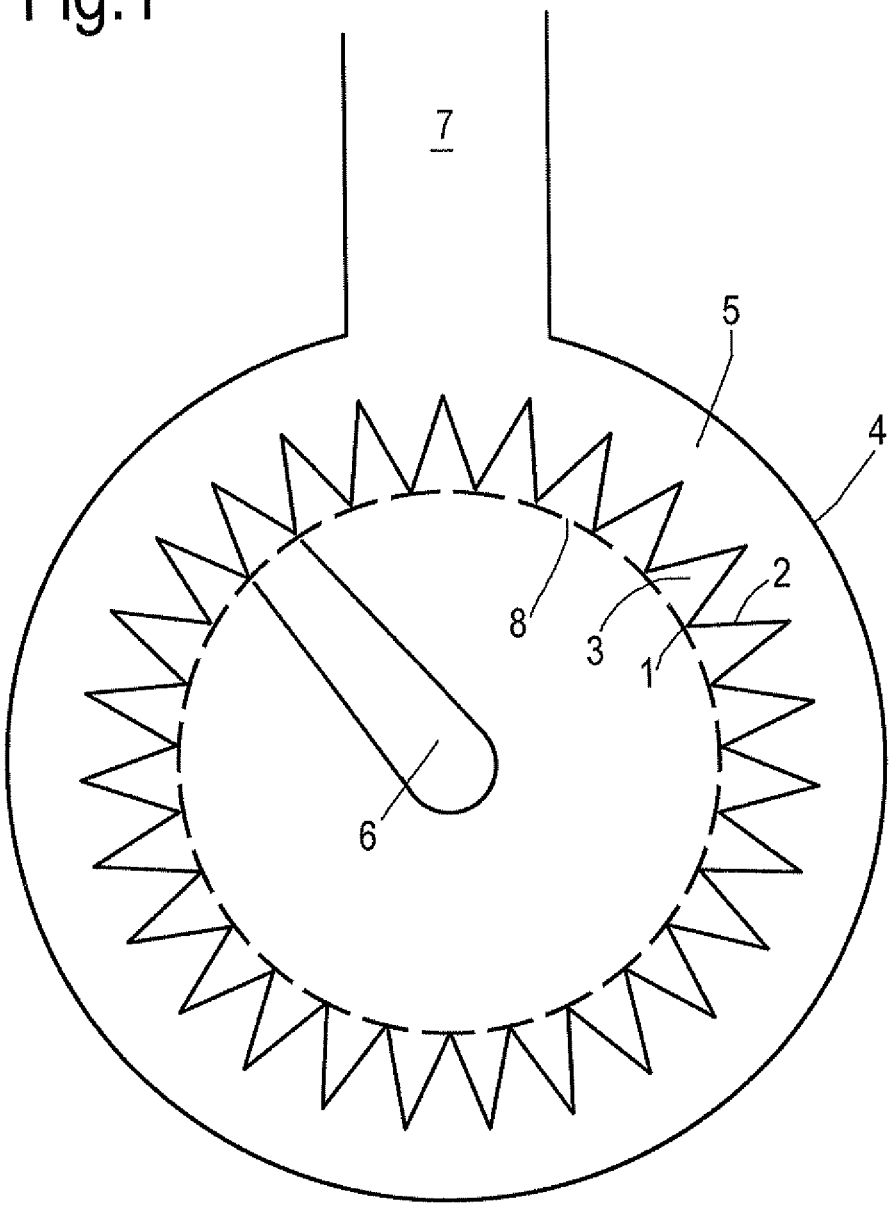

The present application claims priority from PCT/EP2009/067365, filed 17 Dec. 2009, which claims priority from European Application 08172065.8, filed 18 Dec. 2008.

TECHNICAL FIELD OF THE INVENTION

The present invention is directed to a process for removing asphaltenic particles.

WO 2004/092308 describes a process for separating colour bodies and/or asphaltenic contaminants from a hydrocarbon mixture with the help of a membrane arranged in a spirally wound membrane module.

Asphaltenes can be dissolved in a hydrocarbon feed or they can be present in the form of small particles. The form in which the asphaltenes are present depends on circumstances such as concentration, temperature, molecular weight of asphaltene or aggregate of asphaltenes, and further hydrocarbons present. Asphaltenic deposits generally are difficult to remove because they are sticky and amorphous. In the presence of metal sulphides, asphaltenic deposits tend to become extremely sticky.

It has now been found that a specific filter unit is surprisingly suitable for removing asphaltenic particles because the asphaltenic particles which remain behind on the filter, can be removed relatively easily.

The present invention now relates to a process for removing asphaltenic particles from a hydrocarbon feed containing asphaltenic particles by treating the feed in a filter unit comprising a perforated tube surrounded by hollow longitudinal projections comprising a filter having openings of at most 50 micrometer diameter in which the internal space of each of the hollow projections is in fluid communication with the inside of the perforated tube and which filter is regularly subjected to cleaning by treating each of the projections with cleaning fluid wherein the flow of cleaning fluid is opposite to the direction of normal flow.

The filter for use in the present invention is a filter having openings of at most 50 micrometer in which the internal space of each of the hollow projections is in fluid communication with the inside of the perforated tube. It has been found that asphaltenic particles can relatively easily be removed from such filter by treating each of the projections separately with cleaning fluid which flows in the direction which is opposite to the normal flow. A conventional filter unit generally consists of a surface which has to be treated in total during cleaning. However, only part of the total filter surface tends to be cleaned as the cleaning fluid is no longer effective if sufficient surface has become available through which the cleaning fluid can pass. The remainder of the surface area remains clogged. The filter unit of the present invention prevents this as it comprises separate hollow longitudinal projections which preferably are not in fluid communication with each other. This makes that each can be cleaned separately.

Besides the perforated tube and the hollow longitudinal projections, the filter unit for use in the present invention generally further comprises a container having a feed inlet, a filtrate outlet and a residue outlet. The perforated tube can be the feed inlet while it can contain the residue outlet. The container generally is a vessel or a tube.

The normal flow of the feed will be via the perforations of the perforated tube into the internal space of longitudinal projections where it is in contact with the filter. During cleaning of the filter, cleaning fluid passes from outside the filter into the internal space of the longitudinal projections. The asphaltenic particles which have got stuck on the filter on the feed side, are freed and removed via the retentate outlet. Generally, a limited number of projections are cleaned at the same time such that the remainder of the projections can continue filtering feed. The cleaning fluid can be made to flow in the direction opposite to the direction of normal flow by reducing the pressure in the part of the perforated tube which is in fluid communication with the projections to be cleaned. The reduction in pressure can comprise removing overpressure or actually reducing the pressure to below atmospheric. As the remainder of the filter unit generally is at substantially more than atmospheric pressure, it often suffices to lower the pressure of the retentate outlet to atmospheric pressure.

The tube and the hollow projections are in fluid communication via the perforations in the tube. These perforations can have any shape suitable for the specific use such as slits and round openings. In many cases, round openings are preferred.

The further circumstances of use of the present invention determine the specific openings of the filter for use in a filter unit. The absolute rating or cut-off point of a filter refers to the diameter of the largest particle which will pass through the filter. Filter media with an exact and consistent pore size or opening theoretically thus have an exact absolute rating. This does not usually apply in practice as pore size is not necessarily consistent with the actual open areas, and is further modified by the form of the filter element. The opening size of the filter for use in the present invention is measured in accordance with ISO 565 (1987).

The filter for use in the present invention has openings having a diameter of at most 50 micrometer. Preferably, the filter for use in the present invention has openings having a diameter of at most 30 micrometer. The exact size of the asphaltenic particles removed by such filter will differ somewhat from the diameter of the openings. On the one hand, particles having a slightly larger diameter may pass through the filter due to the amorphous character of the asphaltene particles. On the other hand, part of the smaller particles additionally can be removed due to their sticky nature.

The effective filter surface area of a filter is the area through which fluid can actually pass. Filters using profiled wire, so-called wedge wire, have the advantage that they can be cleaned relatively easily but have the disadvantage that their effective surface area is relatively low, generally less than 5%. Filters using metal mesh tend to have a higher effective surface area. Therefore, it is preferred that the filter of the present invention comprises metal mesh. Preferably, the filter comprises at least 2 mesh layers. In this way, the mesh layers provide strength to each other. In a further preferred embodiment, the filter comprises at least 2 mesh layers which have been sintered together to provide a rigid and immobilized mesh structure which gives a sharp and fixed particle separation.

The cleaning fluid can be any fluid known to be suitable to someone skilled in the art. A cleaning fluid which is especially preferred is filtrate of the present process. The use of filtrate for cleaning the filter by which the filtrate has been obtained, is called back-flush operation. It is especially advantageous to use filtrate because it makes that no additional compounds are introduced. This allows easy operation and reduced risk of contamination.

Filters for use in the present invention can be obtained from the company Filtrex s.r.l., Italy. A filter which has been found to be especially suitable is the filter known as the Automatic Counterwash Refining (ACR) filter which is commercially available from this company.

Any feed containing asphaltenic particles can in principle be used in the process of the present invention. It is preferred that the amount of gas in the feed is less than 5% by weight (% wt), based on total amount of feed, more preferably less than 1% wt, more preferably less than 0.5% wt, more preferably less than 0.2% wt, more preferably less than 0.1% wt. Most preferably, the hydrocarbon feed does not contain gas. Further, the hydrocarbon feed to be contacted with the filter preferably is at a pressure of less than 20 bar, more specifically less than 15 bar, more specifically less than 10 bar and most specifically less than 8 bar. The temperature of the feed can vary over a wide range. The temperature can be up to 350° C., more specifically from 100° C. up to and including 300° C., more specifically from 150° C. up to and including 300° C.

Hydrocarbon mixtures from which asphaltenic particles have been found to be especially difficult to remove, are mixtures containing hydrocarbons having a relatively high boiling point. Such mixtures are so-called long residues and short residues. Generally, at least 90% by weight of such feed boils above 300° C., more specifically at least 95% by weight. It has been found that the process of the present invention can remove asphaltenic particles from such feeds.

An especially advantageous embodiment of the present invention comprises combining the filtering process with a further process in which dissolved asphaltenic contaminants are removed with the help of a membrane. In such process, the filtrate is contacted with the feed side of a membrane suitable for removing asphaltenic contaminants and cleaned filtrate is obtained at the permeate side of the membrane. The process removes all asphaltenes, independent from the form in which they are present in the feed. This makes that there is no risk that asphaltenic agglomerates form in the product of this process because all asphaltenic contaminants have been removed. Therefore, the product can be combined with any further hydrocarbons and/or be cooled. It can be treated without constraints although derived from a feed containing asphaltenic contaminants.

It is especially preferred to use a combination of a filter unit and a membrane for treating feeds originating from feeds having a very high asphaltenes content, more specifically feeds of which at least 80% wt, more specifically at least 90% wt, boils below 400° C., more specifically below 300° C., more specifically below 200° C., more specifically below 150° C., most specifically of from 60 to 100° C. The latter is known as naphtha. Such feeds can originate from so-called in-situ conversion of oil shale in which oil shale, also called kerogen, is converted underground with the help of downhole heaters for example such as described in U.S. Pat. No. 4,886,118, WO 2007/050446 and EP-A-1276959. This process produces a hydrocarbon fluid from an oil shale formation by pyrolysing hydrocarbons present in the formation. It is advantageous to use the present invention for treating such formation fluid. It can be advantageous that before the fluid is used in the present invention, particles are removed by using a centrifuge, by washing, by acid washing, by filtration, by electrostatic precipitation, by froth flotation and/or by another type of separation process, and clogging compositions are removed by washing and/or desalting as described in WO 2007/050446.

The membrane for use in the present invention is known from WO-A-2004/092308. The membrane preferably comprises a top layer made of a dense membrane and a base layer made of a porous membrane. The dense membrane, which is well known to one skilled in the art, has properties such that the hydrocarbon mixture passes said membrane by dissolving in and diffusing through its structure. The dense membrane layer is preferably as thin as possible. The thickness preferably is between 1 and 15 micrometer, more preferably between 1 and 5 micrometer. The asphaltenic particles cannot dissolve in a dense membrane because of their more complex structure and high molecular weight. Dense membranes can be made from a polysiloxane, in particular from poly(dimethyl siloxane) (PDMS). The porous membrane layer provides mechanical strength to the membrane. Suitable porous membranes are PolyAcryloNitrile (PAN), PolyAmideImide+$TiO_2$ (PAI), PolyEtherImide (PEI), PolyVinylideneDiFluoride (PVDF), and porous PolyTetraFluoroEthylene (PTFE), and can be of the type commonly used for ultrafiltration, nanofiltration or reverse osmosis.

The membrane is suitably an organophilic or hydrophobic membrane, so that water that may be present in the hydrocarbon mixture is predominantly retained in the retentate.

If the membrane is present in the form of a spirally wound membrane module, a high permeate flux can be maintained over extended periods of time. It is believed that higher turbulence at the membrane feed side, caused by the presence of spacer in a spirally wound membrane, helps to prevent deposition of particles on the membrane. Preferably the spacer has a thickness of at least 0.6 mm, more preferably at least 1 mm, to provide sufficient space at the feed side, and typically a maximum thickness of 3 mm to allow sufficient membrane surface to be packed into a spirally wound module.

During separation the pressure difference across the membrane is typically between 5 and 60 bar and preferably between 10 and 30 bar.

The membrane separation is suitably carried out at a temperature in the range of from −20 to 100° C., in particular of from 10 to 100° C., and preferably in the range of from 30 to 85° C. The wt % recovery of permeate on feed is typically between 50 and 97 wt % and often between 80 and 95 wt %. The trans-membrane pressure over the membrane (pressure difference) is typically in the range of from 1 to 60 bar, specifically of from 3 to 35 bar, more specifically of from 5 to 30 bar, most specifically of from 15 to 25 bar. In many cases, the pressure of the filtrate will be increased before it is contacted with the membrane in order to attain the preferred trans-membrane pressure. As the filtrate is substantially free of solid particles, it is preferred to increase the pressure of the filtrate rather than the pressure of the feed to the filter.

It can be preferred to remove water from the filtrate before the filtrate is contacted with the membrane. The way in which water is removed is determined by the amount of water present and the properties of the membrane. If substantially all water is to be removed, it is generally advantageous to use an electrostatic precipitator. An electrostatic precipitator removes particles with the help of the force of an induced electrostatic charge. If the filtrate is allowed to contain a certain amount of water, it often suffices to use a settler. A settler is a large drum in which water and hydrocarbons are separated on basis of the differences in density.

In some cases, the filtrate contains mercury compounds. In those instances, it can be advantageous to reduce the mercury content with the help of a process as described in WO 2008/116864. It can be especially advantageous to use a mercury trap or entrainment vessel as described in relation with FIG. 3 of WO 2008/116864. Such mercury trap or entrainment vessel comprises a gravity settling tank having an inlet for retentate, an outlet for fluid and a mercury draw-off unit having an inlet at a low point in the tank, preferably at the lowest point. Due to its specific weight, mercury and mercury components will settle and concentrate in the mercury draw-off unit. When after some time mercury components have accumulated to a certain level in the mercury draw-off unit, they can be drawn off via an outlet.

Figure 2:
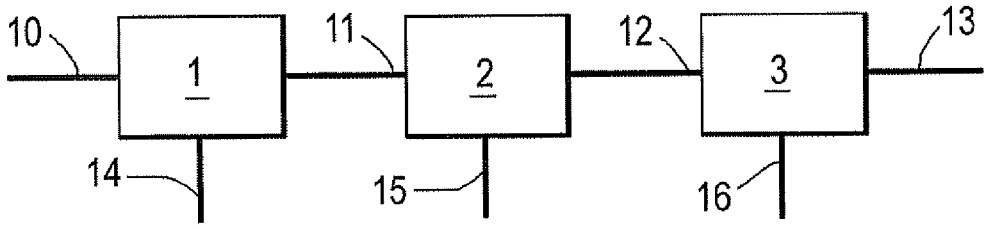
Figure 3:
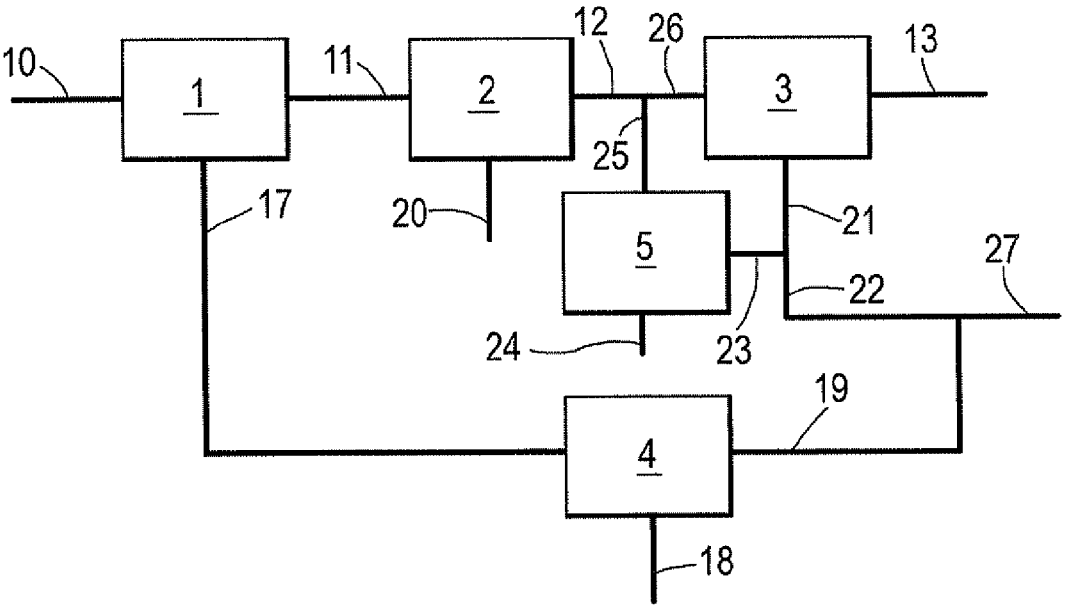

The invention will be described in more detail and by means of non-limiting examples, with reference to the Figures, wherein FIG. 1 schematically shows a cross-section of a filter unit;

FIG. 2 schematically shows a process in which the present invention can be applied; and FIG. 3 schematically shows a further process in which the present invention can be applied.

FIG. 1 schematically shows a cross-section of a filter unit for use in the present invention. The cross section is perpendicular to the longitudinal projections and the perforated tube. The filter unit comprises a perforated tube 1 surrounded by hollow longitudinal projections 3 comprising filter 2. The longitudinal projections 3 are surrounded by a further tube 4 having an outlet 7 for removing the filtrate. The longitudinal projections 3 are in fluid communication with tube 1 via openings 8. During normal operation, the pressure in the perforated tube 1 is higher than the pressure in space 5 formed by the outside of the longitudinal projections and the further tube 4. This makes that feed flows from the perforated tube into the projections 3, and filtrate flows to space 5 and from there to outlet 7. The filter 2 can be cleaned by decreasing the pressure in the part of the perforated tube which is in fluid communication with the projections to be cleaned. This can for example be done with the help of a conduit 6 which can rotate around the longitudinal axis of perforated tube 1 such that all projections can be treated. During cleaning of the projections in question, the projections 3 are in fluid communication with conduit 6 while the pressure in conduit 6 is lower than the pressure in the space 5. This makes that filtrate flows from space 5 into projection 3 and then into conduit 6. Residue accumulated on filter 2 is thereby removed and flows via conduit 6 to a residue outlet connected therewith.

In FIGS. 2 and 3, unit 1 is a filter unit as described above, unit 2 is a dewatering unit and unit 3 is a spirally wound membrane unit. These set-ups are especially suitable for treating feed originating from in-situ conversion of oil shale.

FIG. 2 schematically shows a process in which the feed comprising asphaltenic particles is introduced into filter unit 1 via line 10. Asphaltenic particles and other solids which do not pass the filter, can be removed via line 14. The filtrate is sent to a dewatering unit 2 which can comprise a settler or an electrostatic precipitator dependent on the amount of water present and the properties of the membrane. The water separated off is removed via line 15 and the dewatered hydrocarbons are sent via line 12 to membrane unit 3. Permeate is removed from unit 3 via line 13 and retentate is removed via line 16.

FIG. 3 schematically shows a more detailed process according to the present invention. Where the same reference numerals are used in FIGS. 2 and 3, they refer to the same or similar objects. In the process of FIG. 3, the asphaltenic particles and other solids removed by the filter in filter unit 1 are sent via line 17 19 to a settler 4 for separating mineral particles from hydrocarbonaceous compounds. The mineral particles can be removed via line 18 while the hydrocarbonaceous compounds are sent via line 19 to line 27 for further treatment. The filtrate of unit 1 is sent via line 11 to dewatering unit 2 where water is removed via line 22. The dewatered hydrocarbons are sent via line 12 to membrane unit 3. Retentate of membrane unit 3 is removed via line 23 and can be sent via lines 21 and 23 to unit 5 for removing mercury and/or via lines 21 and 22 to line 27 for further treatment. It is preferred that part of the retentate of membrane unit 3 is removed as bleed stream in order to prevent build-up of contaminants. Unit 5 preferably comprises a mercury trap (entrainment vessel) as described in WO 2008/116864 in relation with FIG. 3 as discussed above. When after some time mercury components have accumulated to a certain level, they can be drawn off via an outlet to line 24. The retentate from which the bulk of the mercury has been removed, can be withdrawn via line 25 and be combined with the fluid of line 12 and again be treated in membrane unit 3.

What is claimed is:

1. A process for removing asphaltenic contaminants from a hydrocarbon feed having at least 90% by weight of the hydrocarbon feed being hydrocarbons boiling above 300° C. and containing asphaltenic particles by: treating the hydrocarbon feed in a filter unit comprising a perforated tube surrounded by hollow longitudinal projections comprising a filter having openings of at most 50 micrometer diameter in which the internal space of each of the hollow projections is in fluid communication with the inside of the perforated tube to yield a filtrate and which the filter is subjected to cleaning by treating each of the projections with a cleaning fluid wherein the flow of cleaning fluid is opposite to the direction of normal flow of the hydrocarbon feed.

2. A process according to claim 1, in which the filter has openings having a diameter of at most 30 micrometer diameter.

3. A process according to claim 1, in which the filter comprises metal mesh.

4. A process according to claim 3, in which the filter comprises at least 2 mesh layers.

5. A process according to claim 1, in which the cleaning fluid is filtrate of the process.

6. A process according to claim 1, further comprising: contacting the filtrate obtained thereby with a feed side of a membrane suitable for removing asphaltenic contaminants from the hydrocarbon feed.

7. A process according to claim 1, in which the hydrocarbon feed is obtained by pyrolysis of oil shale.

8. A process according to claim 6, which process further comprises removing water from the filtrate before contacting the filtrate with the membrane.

* * * * *